US009574750B1

(12) United States Patent
Hetrick

(10) Patent No.: US 9,574,750 B1
(45) **Date of Patent: *Feb. 21, 2017**

(54) SINGLE AXIS ADJUSTMENT FOR EMERGENCY LIGHTS EMITTING AN ASYMMETRIC BEAM PATTERN TO ILLUMINATE A PATH OF EGRESS

(71) Applicant: Cooper Technologies Company, Houston, TX (US)

(72) Inventor: Westly Davis Hetrick, Atlanta, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/798,242

(22) Filed: Jul. 13, 2015

Related U.S. Application Data

(63) Continuation of application No. 13/869,266, filed on Apr. 24, 2013, now Pat. No. 9,080,747.

(60) Provisional application No. 61/638,358, filed on Apr. 25, 2012, provisional application No. 61/642,325, filed on May 3, 2012.

(51) Int. Cl.

| | |
|---|---|
| ***F21V 17/02*** | (2006.01) |
| ***F21V 14/06*** | (2006.01) |
| ***F21V 15/01*** | (2006.01) |
| ***F21V 33/00*** | (2006.01) |
| ***G09F 13/04*** | (2006.01) |
| ***G09F 13/22*** | (2006.01) |
| *F21Y 101/02* | (2006.01) |

(52) U.S. Cl.
CPC ..... *F21V 14/06* (2013.01); *F21V 15/01* (2013.01); *F21V 33/0076* (2013.01); *G09F 13/04* (2013.01); *G09F 13/22* (2013.01); *F21Y 2101/02* (2013.01); *G09F 2013/0459* (2013.01); *G09F 2013/222* (2013.01)

(58) Field of Classification Search
CPC ..... F21V 14/06; F21V 15/01; F21V 33/0076; F21V 33/00; F21V 21/041; F21V 21/047; F21V 17/162; F21V 17/02; G09F 13/04; G09F 13/0404; G09F 13/22; G09F 13/0459; G09F 2013/222
See application file for complete search history.

(56) References Cited

U.S. PATENT DOCUMENTS

| | | | |
|---|---|---|---|
| 1,955,599 | A | 4/1934 | Lamblin-Parent |
| 4,654,764 | A | 3/1987 | Hsiao |

(Continued)

*Primary Examiner* — Y M Lee
(74) *Attorney, Agent, or Firm* — King & Spalding LLP

(57) ABSTRACT

A light fixture includes a housing and at least one adjustable light assembly coupled thereto. Each light assembly includes a light source and an optic lens that is disposed over at least a portion of the light source. At least a portion of the lens is positioned external to the housing. The lens is rotatably adjustable about an axis extending perpendicular from the lens and includes a portion of the light source. The lens emits an asymmetrical light output. A light source holder may be included as part of the light assembly and is used to couple the light assembly to the housing. The light source holder includes a first surface, a second surface opposite the first surface, and an aperture extending therethrough. The light source is positioned adjacent the first surface over the aperture while the lens is positioned adjacent the second surface over the aperture.

18 Claims, 5 Drawing Sheets

(56) References Cited

U.S. PATENT DOCUMENTS

| | | | | |
|---|---|---|---|---|
| 4,697,890 | A | 10/1987 | Crookston | |
| 4,912,609 | A * | 3/1990 | Gillette | F21S 8/035 362/147 |
| 6,193,395 | B1 | 2/2001 | Logan | |
| 6,783,264 | B2 | 8/2004 | Felty | |
| 6,824,295 | B1 | 11/2004 | Grondal | |
| 6,877,880 | B2 | 4/2005 | Endo | |
| 7,641,366 | B1 | 1/2010 | Sibalich et al. | |
| 7,959,326 | B2 | 6/2011 | Laporte | |
| 9,080,747 | B1 * | 7/2015 | Hetrick | F21V 14/06 |
| 2008/0055888 | A1 | 3/2008 | Sharrah et al. | |
| 2008/0266856 | A1 | 10/2008 | Chien | |
| 2008/0276509 | A1 * | 11/2008 | Yu | F21V 23/04 362/20 |
| 2009/0310356 | A1 * | 12/2009 | Laporte | F21V 5/007 362/239 |
| 2010/0014290 | A1 | 1/2010 | Wilcox | |
| 2013/0258677 | A1 * | 10/2013 | Fryzek | F21V 29/004 362/326 |

* cited by examiner

SINGLE AXIS ADJUSTMENT FOR EMERGENCY LIGHTS EMITTING AN ASYMMETRIC BEAM PATTERN TO ILLUMINATE A PATH OF EGRESS

CROSS REFERENCE TO RELATED APPLICATIONS

The present application is a continuation of and claims priority under 35 U.S.C. §120 to U.S. Non-Provisional patent application Ser. No. 13/869,266, titled "Single Axis Adjustment For Emergency Lights Emitting An Asymmetric Beam Pattern To Illuminate A Path Of Egress," and filed Apr. 24, 2013 which claims priority under 35 U.S.C. §119(e) to U.S. Provisional Patent Application No. 61/638,358 titled "Three Axis Adjustment For Emergency Lights Emitting An Asymmetric Beam Pattern To Illuminate A Path Of Egress" filed on Apr. 25, 2012, and to U.S. Provisional Patent Application No. 61/642,325 titled "Single Axis Adjustment For Emergency Lights Emitting An Asymmetric Beam Pattern To Illuminate A Path Of Egress" filed on May 3, 2012, the entire contents of both which are hereby incorporated by reference herein.

TECHNICAL FIELD

The present disclosure relates generally to lighting solutions, and more particularly to systems, methods, and devices for providing an emergency lighting fixture that includes a rotatable optic for refining the direction of light emitted therefrom.

BACKGROUND OF THE INVENTION

Emergency lighting is typically used to illuminate a path of egress away from an area experiencing power failure or during other emergency conditions. Conventional emergency lighting fixtures include either a fixed optic or an adjustable lighting head that can be adjusted to aim the light emitted therefrom to the designated path of egress. These adjustable lighting heads typically emit a symmetrical beam of light and have two adjustment axes for aiming the emitted light in a particular direction. One of the adjustment axes allows for the adjustable lighting head to be rotated 360 degrees about a vertical axis, while the other adjustment axes allows for the adjustable lighting head to be adjustable, or tiltable, less than ninety degrees about a horizontal axis. However, there are some adjustable lighting heads that emit an asymmetrical beam, but they do not provide additional adjustment mechanisms, such as an additional adjustment axis, for refining the emitting direction of the asymmetrical beam.

BRIEF DESCRIPTION OF THE DRAWINGS

The foregoing and other features and aspects of the invention are best understood with reference to the following description of certain exemplary embodiments, when read in conjunction with the accompanying drawings, wherein.

Figure 1:
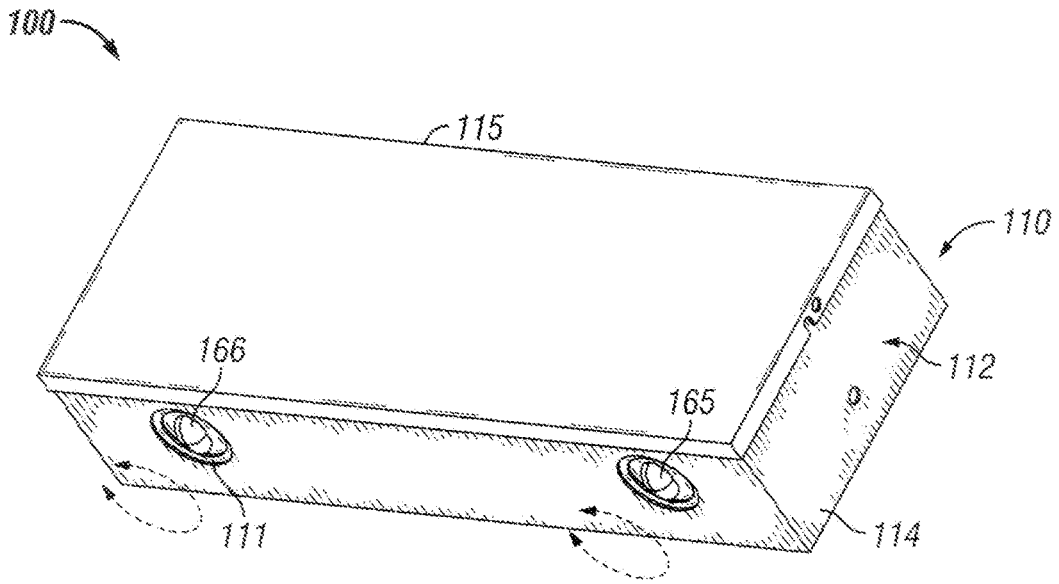
FIG. 1 is a perspective view of an emergency lighting fixture with a portion of a lighting assembly removed in accordance with an exemplary embodiment.

The drawings illustrate only exemplary embodiments of the invention and are therefore not to be considered limiting of its scope, as the invention may admit to other equally effective embodiments. The elements and features shown in the drawings are not necessarily to scale, emphasis instead being placed upon clearly illustrating the principles of the exemplary embodiments. Additionally, certain dimensions or positionings may be exaggerated to help visually convey such principles.

DETAILED DESCRIPTION OF THE EXEMPLARY EMBODIMENTS

The exemplary embodiments disclosed herein are directed to systems, methods, and devices for providing an emergency lighting fixture that includes a rotatable optic for refining the direction of an asymmetric beam of light emitted therefrom and will be described more fully hereinafter with reference to the accompanying drawings, in which exemplary embodiments are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. The invention is better understood by reading the following description of non-limiting, exemplary embodiments with reference to the attached drawings, wherein like parts of each of the figures are identified by like reference characters, and which are briefly described as follows.

Figure 2A:
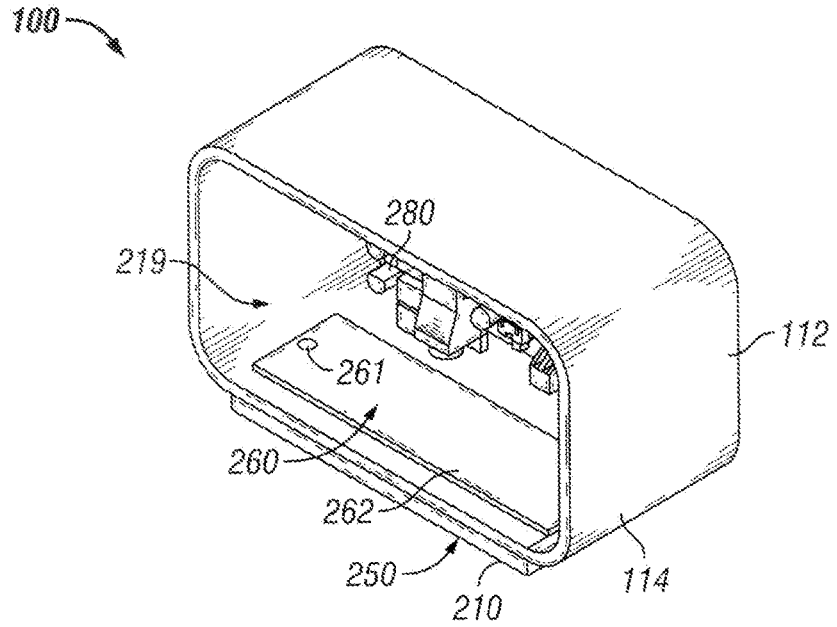
FIGS. 2A-2C are several views of the emergency lighting fixture of FIG. 1 including the entire lighting assembly with a cover panel and a battery removed in accordance with an exemplary embodiment.
Figure 2B:
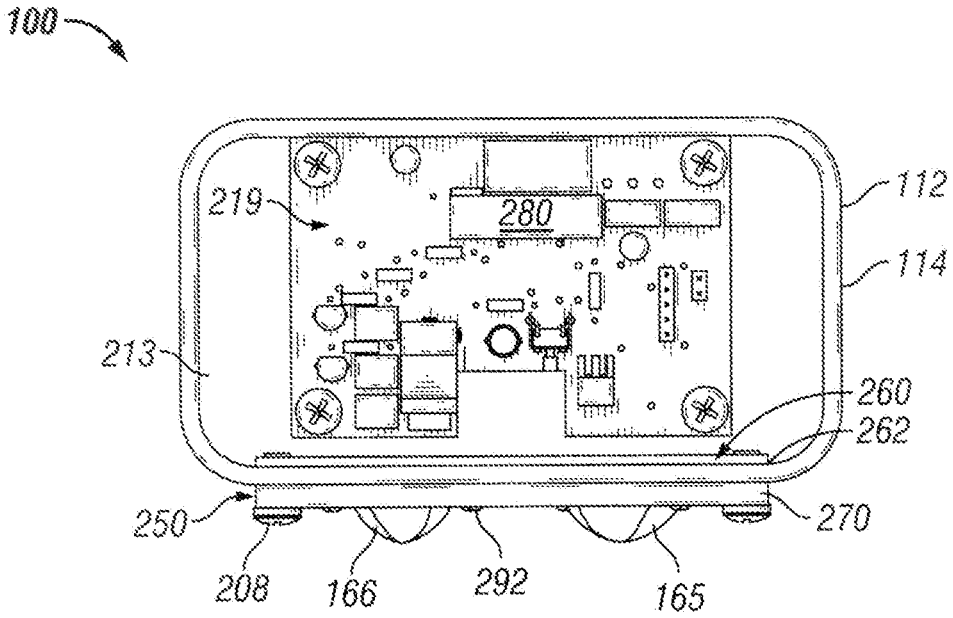
Figure 2C:
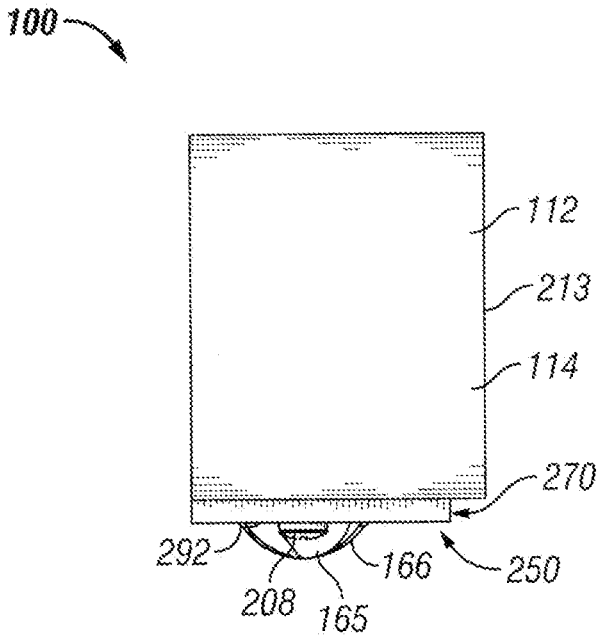

FIG. 1 is a perspective view of an emergency lighting fixture 100 with a portion of a lighting assembly 250 removed in accordance with an exemplary embodiment. FIGS. 2A-2C are several views of the emergency lighting fixture 100 including the entire lighting assembly 250 with a cover panel 115 and a battery (not shown) removed in accordance with an exemplary embodiment. Referring to FIGS. 1-2C, the emergency lighting fixture 100 includes a housing 110 and the lighting assembly 250. According to some exemplary embodiments, the emergency lighting fixture 100 also includes additional electronic devices 280, such as a light emitting diode (LED) driver. Emergency lighting fixtures, as used within this disclosure, includes any and all types of emergency lighting devices and egress lighting devices which includes, but is not limited to, exit signs. Although the description herein has been provided with respect to emergency lighting devices, the description is applicable to any lighting fixture type.

The housing 110 includes a base panel 112 and a cover panel 115 that couples to the base panel 112. The exemplary cover panel 115 snaps onto the base panel 112. Alternatively, the cover panel 115 is coupled to the base panel 112 in other manners, such as by using screws or latches. The base panel 112 includes a base 213 and multiple sidewalls 114 extending orthogonally out from the perimeter of the base 213, thereby forming a cavity 219 therein. The base 213 is substantially planar according to some exemplary embodiments, while in other exemplary embodiments, the base 213 is non-planar. Further, according to some exemplary embodiments, one or more sidewalls 114 extend outwardly from the perimeter of the base 213 in a non-orthogonal manner. The cavity 219 houses at least a portion of the lighting assembly 250 and one or more electronic devices 280, such as an LED driver or ballast (depending on the light source), localized temporary power source (such as a battery or supercapacitor), and wiring to couple the emergency lighting fixture 100 to a power source (not shown). At least some of the electronic devices 280 are coupled to the base 213 according to some exemplary embodiments, such as being placed on a board and being fastened, via screw or via fastening clips, to the inner surface of the base 213. At least one of the sidewalls 114 includes two openings 111 formed therein and oriented to face substantially downward when the emergency lighting fixture 100 is mounted to a mounting platform (not shown), for example, a pole or a wall. Although the exemplary embodiment of FIG. 1 depicts two openings 111 being formed within one of the sidewalls 114, alternatively, greater or fewer openings 111 are formed within one or more sidewalls 114 in other exemplary embodiments. The sidewall 114 that includes the openings 111 also includes one or more apertures 309 (FIG. 3) extending therethrough. These apertures 309 (FIG. 3) are configured to receive a fastening device 208 therethrough and facilitate in coupling the lighting assembly 250 to the housing 110. The housing 110 is fabricated using aluminum, but is alternatively fabricated using other suitable materials or combinations of different materials, such as other metals, metal alloys, or plastics.

Figure 3:
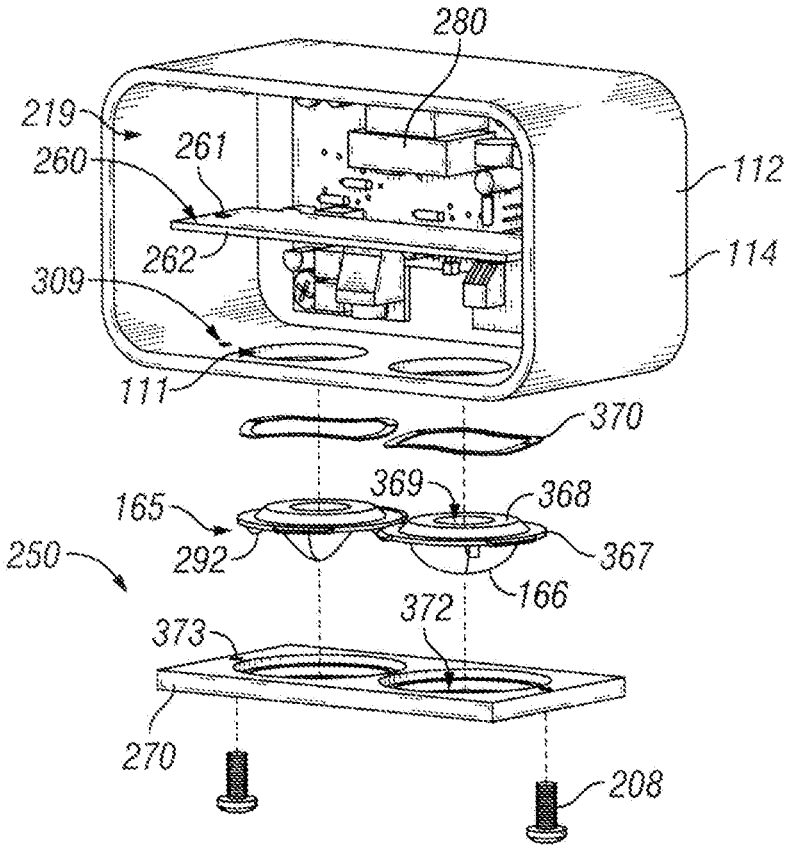
FIG. 3 is an exploded view of the lighting assembly being coupled to a housing of the emergency lighting fixture of FIGS. 2A-2C in accordance with an exemplary embodiment.

FIG. 3 is an exploded view of the lighting assembly 250 being coupled to the housing 110 of the emergency lighting fixture 100 in accordance with an exemplary embodiment. Referring to FIGS. 1-3, the lighting assembly 250 includes a light source 260, one or more compression devices 370, one or more optical lenses 165, and a compression plate 270.

In one exemplary embodiment, the light source 260 includes a substrate 262 and one or more LED die packages (not shown), or LEDs, coupled onto the surface of the substrate 262. Although the light source 260 is described as including at least one LED die package, or at least one LED, the light source 260 can be any other type of light source, including chip-on-board LEDs or fluorescent lamps. The substrate 262 includes one or more sheets of ceramic, metal, laminate, circuit board, Mylar®, or another suitable material. The substrate 262 also includes one or more apertures 261 extending therethrough and positioned at substantially opposite ends of the substrate 262. However, the positioning and/or the number of apertures 261 formed through the substrate 262 is different in other exemplary embodiments. The apertures 261 are positioned in alignment with each respective aperture 309 formed in the sidewall 114 when the substrate 262 is positioned adjacently on the side wall 114. The light source 260 is coupled to the sidewall 114 within the cavity 219 and is oriented to emit light through one or more respective openings 111 formed through the sidewall 114 of the housing 110.

The exemplary optical lens 165 is fabricated from an acrylic material, but alternatively is fabricated from other suitable materials, such as glass or polymers, that are either transparent or translucent. The optical lens 165 includes a dome portion 166, a base portion 367 surrounding the dome portion 166, and a protrusion portion 368 coupled to the base portion 367 and also surrounding the dome portion 166. The optical lens 165 is disposed over the light source 260 and is shaped to manipulate the light emitted from the light source 260. According to certain exemplary embodiments, the optical lens 165 is disposed over the light source 160 by positioning the optical lens 165 over the opening 111 from an exterior side of the sidewall 114. In certain exemplary embodiments, the dome portion 166 is asymmetrically shaped and produces an asymmetric beam output. Although the dome portion 166 is asymmetrically shaped in certain exemplary embodiments, the dome portion 166 is symmetrically shaped and still produces an asymmetric light output using devices such as mirrors, prisms, total internal reflection (TIR), or other known methods to produce an asymmetric beam output. Alternatively, the optic lens 165 includes a recessed portion (not shown) which extends inwardly towards the LED, which includes, for example, a collimating lens. According to some exemplary embodiments, the base portion 367 is dimensioned to be slightly larger than the opening 111 so that it is not inserted into the opening 111 when the optical lens 165 is disposed over the light source 260. The protrusion portion 368 extends out from the base portion 367 in a direction away or opposite from the direction of the dome portion 166. The protrusion portion 367 is dimensioned to be inserted within the opening 111 when the lens optic 165 is disposed over the light source 260. An opening 369 is formed within both the base portion 367 and the protrusion portion 368 to allow light emitted from the light source 260 to enter into the interior of the dome portion 166 when the optic lens 165 is disposed over the light source 260.

The compression device 370 is substantially annular in shape and is disposed on the base portion 367 and around the protrusion portion 368. Further, the compression device 370 is disposed between the base portion 367 and an exterior surface of the sidewall 114, such that the compression device 370 surrounds the opening 111. Each compression device 370 is used with each optical lens 165 according to certain exemplary embodiments. The compression device 370 is fabricated from a metal material, but other suitable materials, such as silicone or rubber, is used in other exemplary embodiments. The compression device 370 prevents unintentional movement, or rotation, of the optical lens 165. In one exemplary embodiment, the compression device 370 is a wave spring.

The exemplary compression plate 270 has a rectangular shape and includes one or more openings 372 formed therethrough. However, in other exemplary embodiments, the compression plate 270 is formed having a different geometric or non-geometric shape. Each opening 372 is configured to receive at least a portion of the dome portion 166 of the optical lens 165. In certain exemplary embodiments, the perimeter of each opening 372 is less than the perimeter of the respective base portion 367 of the optical lens 165 that is inserted within the opening 372. The compression plate 270 also includes one or more apertures 373 extending therethrough and positioned at substantially opposite ends of the compression plate 270. However, the positioning and/or the number of apertures 373 formed through the compression plate 270 is different in alternative exemplary embodiments. The apertures 373 are axially aligned with each respective aperture 261 of the substrate 262 and each respective aperture 309 formed in the sidewall 114 when the substrate 262 and the compression plate 270 are positioned adjacently on opposite sides of the side wall 114.

The coupling of the lighting assembly 250 to the housing 110 is described while referencing FIGS. 2A-3. Referring to FIGS. 2A-3, the light source 260 is disposed onto one of the sidewalls 114 having the openings 111 formed therein and oriented so that the light emitted from the LEDs are directed towards the respective opening 111. The light source 260 is positioned within the cavity 219. Further, the light source 260 is oriented so that each aperture 261 of the substrate 262 is aligned with each respective aperture 309 of the sidewall 114. The dome portion 166 of each optical lens 165 is inserted at least partially through the respective opening 372 formed in the compression plate 270. Each compression device 370 is disposed on a respective base portion 367 and around the respective protrusion portion 368. The compression plate 270, the optical lens 165, and the compression devices 370 are moved towards the sidewall 114 having the openings 111 formed therein until the optical lens 165 is disposed adjacent and over the LEDs and the apertures 373 of the compression plate 270 are aligned with each respective aperture 261 of the substrate 262 and each respective aperture 309 formed in the sidewall 114. The fastening device 208 is inserted through each of the apertures 373, 261, 309 to couple the light assembly 250 to the housing 110.

The optical lens 165 is rotatable 360 degrees and moves about a vertical axis extending through the respective openings 111, 372. According to certain exemplary embodiments, the base portion 367 also includes one or more control surfaces 292 that extend away from the base portion 367 in a similar direction as the dome portion 166. These control surfaces 292 facilitate rotation of the optical lens 165 without having to physically make contact with the optical lens 165 by using an operator's fingers or a tool. According to some exemplary embodiments, since the optical lens 165 produces an asymmetric light output, rotation of the optical lens 265 allows an operator to further refine the direction of light output.

Although one example has been provided which allows the optical lens 165 to rotate about 360 degrees, the lighting assembly 250 is fabricated and/or coupled to the housing 110 in different manners in other exemplary embodiments, which allow the optical lens 165 to rotate 360 degrees or less about the same vertical axis. For example, in some alternative exemplary embodiments, the entire optical assembly 250 is disposed within the cavity 219 of the housing 110 and still allows the optical lens 165 to rotate 360 degrees. Although the optical lens 165 is described to rotate 360 degrees, it can be configured to rotate less than 360 degrees in other exemplary embodiments, such as through the use of position stops placed in the path of the control surfaces 292 or other known techniques.

Figure 4:
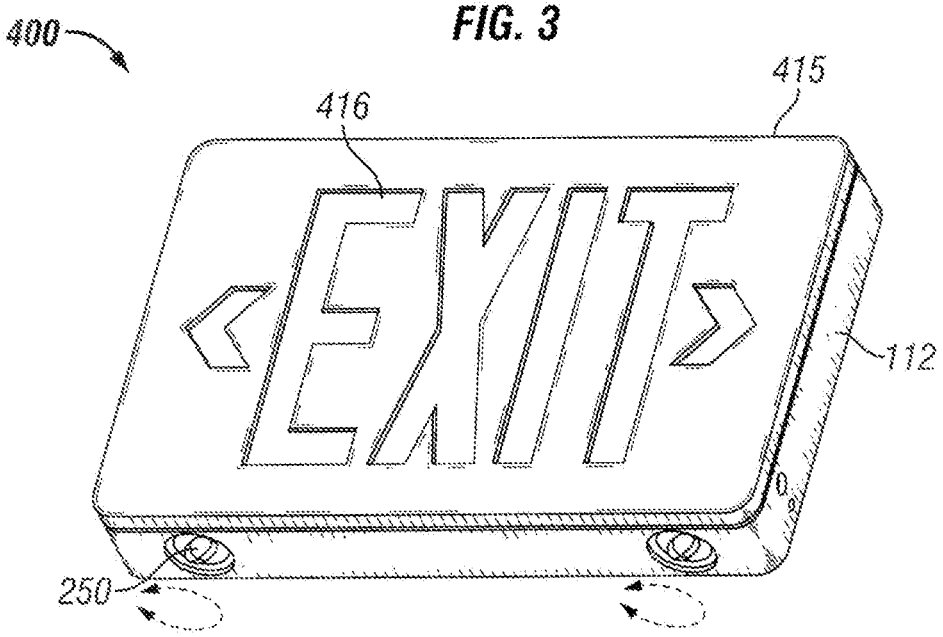
FIG. 4 is a perspective view of an exit and emergency combination lighting fixture in accordance with another exemplary embodiment.

FIG. 4 is a perspective view of an exit and emergency combination lighting fixture 400 in accordance with another exemplary embodiment. The exit and emergency combination lighting fixture 400 is similar to the emergency lighting fixture 100 (FIG. 1) except that the cover panel 415 is different than the cover panel 115 (FIG. 1) and an additional light source (not shown) is added into the cavity 219 (FIG. 2) of the base panel 112 which is directed to emit light towards the cover panel 415 and through one or more emission openings 416 formed in the cover panel 415. The cover panel 415 includes one or more emission openings 416 formed therein to spell out the word "EXIT", however, the one or more emission openings 416 are formed into letters, numbers, words, and/or symbols according to other exemplary embodiments. The lighting assembly 250 is coupled to the base panel 112 in the same manners as described above.

Figure 5:
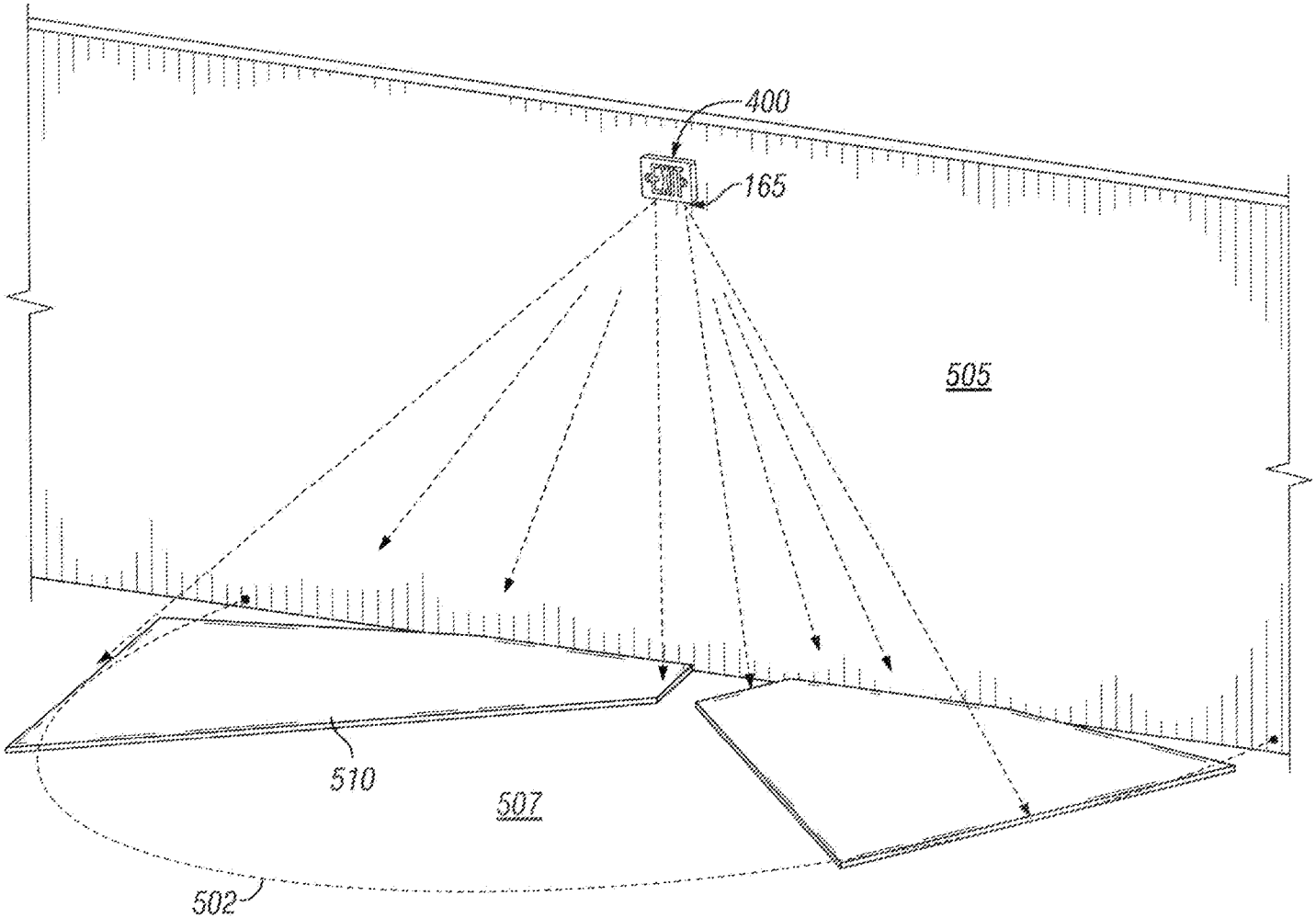
FIG. 5 is a schematic view of the exit and emergency combination lighting fixture of FIG. 4 showing paths of light formed by the exit and emergency combination lighting fixture and the adjustability of the paths of light in accordance with an exemplary embodiment.

FIG. 5 is a schematic view of the exit and emergency combination lighting fixture 400 showing paths of light 510 formed by the exit and emergency combination lighting fixture 400 and the adjustability of the paths of light 510 in accordance with an exemplary embodiment. Referring to FIG. 5, the exit and emergency combination lighting fixture 400 is mounted to a mounting structure 505. In certain exemplary embodiments, the mounting structure 505 is a wall, ceiling or any other suitable structure, such as a pole. The exit and emergency combination lighting fixture 400 emits an asymmetric beam of light to illuminate a path 510 substantially onto a floor surface 507. The optical lens 165 is oriented, or rotated, to collectively emit lighted paths 510 that create a substantially parallel path of egress. Alternatively, the same optic lens 165 is oriented, or rotated, to collectively emit lighted paths 510 that create a substantially perpendicular path of egress. The exit and emergency combination lighting fixture 400 is capable of emitting paths of light 510 from the optical lens 165 where selective portions of a lightable circumference 502 is lit. This lightable circumference 502 illustrates the paths of light 510 that is formable from the exit and emergency combination lighting fixture 400 when the optical lens 165 is rotated about 180 degrees. According to some exemplary embodiments where two or more optical lenses 165 are used, one or more of the optical lenses 165 include a dome portion 166 (FIG. 1) that is shaped differently than the dome portion 166 (FIG. 1) of at least one other optical lens 165.

Figure 6:
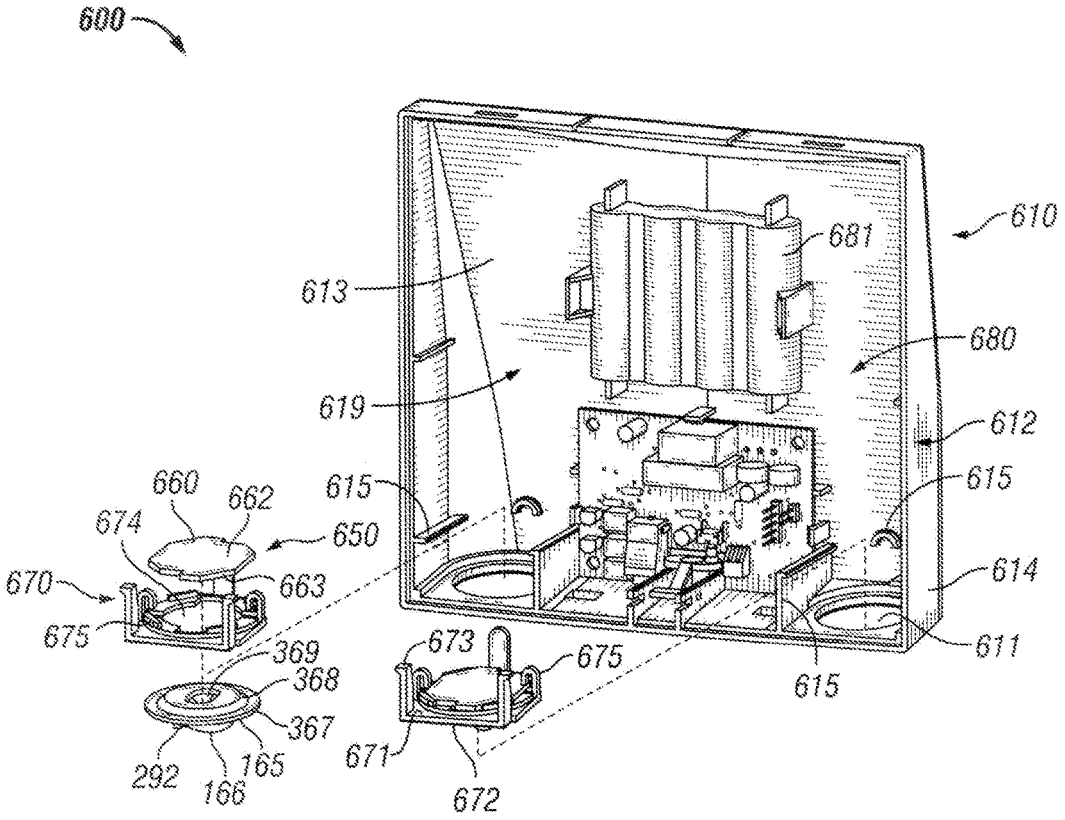
FIG. 6 is an exploded view of a lighting assembly being coupled to a housing of a lighting fixture in accordance with yet another exemplary embodiment.

FIG. 6 is an exploded view of a lighting assembly 650 being coupled to a housing 610 of a lighting fixture 600 in accordance with yet another exemplary embodiment. Referring to FIG. 6, the lighting fixture 600 includes a housing 610 and the lighting assembly 650. According to some exemplary embodiments, the lighting fixture 600 also includes additional electronic devices 680, such as a light emitting diode (LED) driver. Lighting fixtures, as used within this disclosure, includes any and all types of lighting devices and egress lighting devices which includes, but is not limited to, emergency lighting devices such as exit signs.

The housing 610 includes a base panel 612 and a cover panel (not shown) that couples to the base panel 612. The exemplary cover panel snaps onto the base panel 612. Alternatively, the cover panel is coupled to the base panel 612 in other manners, such as by using screws or latches. The base panel 612 includes a base 613 and multiple sidewalls 614 extending orthogonally out from the perimeter of the base 613, thereby forming a cavity 619 therein. The base 613 is non-planar according to some exemplary embodiments, while in other exemplary embodiments, the base 613 is substantially planar. Further, according to some exemplary embodiments, one or more sidewalls 614 extend outwardly from the perimeter of the base 613 in a non-orthogonal manner. The cavity 619 houses at least a portion of the lighting assembly 650 and one or more electronic devices 680, such as an LED driver or ballast (depending on the light source), localized temporary power source 681 (such as a battery or supercapacitor), and wiring to couple the lighting fixture 600 to a power source (not shown). At least some of the electronic devices 680 are coupled to the base 613 according to some exemplary embodiments, such as being placed on a board and being fastened, via screw or via fastening clips, to the inner surface of the base 613. At least one of the sidewalls 614 includes two openings 611 formed therein and oriented to face substantially downward when the lighting fixture 600 is mounted to a mounting platform (not shown), for example, a pole or a wall. Although the exemplary embodiment of FIG. 6 depicts two openings 611 being formed within one of the sidewalls 614, alternatively, greater or fewer openings 611 are formed within one or more sidewalls 614 in other exemplary embodiments. Further, according to some exemplary embodiments, the base 613 and/or sidewalls 614 includes one or more fastening devices 615 configured to receive at least a portion of the lighting assembly 650 and facilitate in coupling the lighting assembly 650 to the housing 610. The housing 610 is fabricated using aluminum, but is alternatively fabricated using other suitable materials or combinations of different materials, such as other metals, metal alloys, or plastics.

The lighting assembly 650 includes at least one light source 660, at least one light source holder 670, and one or more optical lenses 165.

In one exemplary embodiment, the light source 660 includes a substrate 662 and one or more LED die packages (not shown), or LEDs, coupled onto the surface of the substrate 662. Although the light source 660 is described as including at least one LED die package, or at least one LED, the light source 660 can be any other type of light source, including chip-on-board LEDs or fluorescent lamps. The substrate 662 includes one or more sheets of ceramic, metal, laminate, circuit board, Mylar®, or another suitable material. The substrate 662 is shaped is substantially square-shaped with one or more chamfers 663 at the corners; however, the substrate 662 is shaped into a different geometric or non-geometric shape in other exemplary embodiments. The light source 660 is coupled to the light source holder 670, which is described in further detail below, within the cavity 619 and is oriented to emit light through one or more respective openings 611 formed through the sidewall 614 of the housing 610.

The light source holder 670 is formed with a profile larger than the openings 611 and includes a first surface 671, a second surface 672 facing a direction opposite the first surface 671, one or more prongs 673 extending substantially orthogonal away from the first surface 671, and an aperture 674 formed therein extending from the first surface 671 to the second surface 672. Three prongs 673 are formed in the light source holder 670; however, greater or fewer prongs 673 are formed in other exemplary embodiments. These prongs 673 are configured to be coupled to the fastening devices 615 so that the light source holder 670 is stationary once coupled to the housing 610. The aperture 674 is dimensioned to allow light from the light source 660 to pass therethrough once the light source 660 is disposed adjacently above the first surface 671. At least a portion of the first surface 671 surrounding the aperture 674 provides support to the light source 660, according to certain exemplary embodiments, when the light source 660 is coupled to the light source holder 670. Optionally, one or more positional features 675 also are formed along the first surface 671 surrounding portions of the aperture 674. These positional features 675 prevent the light source 660 from rotating once the light source 660 is coupled to the light source holder 670.

The exemplary optical lens 165 has been described above and therefore is not repeated herein for the sake of brevity. The dome portion 166 is dimensioned smaller than the opening 611 so that the dome portion 166 is insertable therethrough from an interior of the cavity 619. However, the base portion 367 is dimensioned larger than the aperture 674 and the opening 611 so that the base portion 367 is prevented from being insertable through either. The optical lens 165 is disposed over the light source 660 and is shaped to manipulate the light emitted from the light source 660. According to certain exemplary embodiments, the optical lens 165 is disposed over the light source 660 by positioning the optical lens 165 over the aperture 674 from the second surface 672 of the light source holder 670. An opening 369 is formed within both the base portion 367 and the protrusion portion 368 to allow light emitted from the light source 660 to enter into the interior of the dome portion 166 when the optic lens 165 is disposed over the light source 660.

The coupling of the lighting assembly 650 to the housing 610 is described while referencing FIG. 6. Referring to FIG. 6, the light source 660 is disposed on the first surface 671 of the light source holder 670 over the aperture 674. The light source 660 is oriented on the first surface 671 so that the LEDs are oriented to emit light through the aperture 674. Further, the light source 660 is positioned on the first surface 671 such that the positional features 675 retain the light source 660 in a non-rotational manner with respect to the light source holder 670. The optic lens 165 is positioned adjacent the second surface 672 of the light source holder 670 such that the opening 369 is axially aligned with the LED. Hence, the light source 660, the light source holder 670, and the optic lens 165 collectively form the lighting assembly 650. Once assembled, the lighting assembly 650 is inserted into the cavity 619 and each of the prongs 673 are coupled to each respecting fastening device 615. Once the prongs 673 are coupled to the fastening device 615, at least a portion of the optic lens 165 has been inserted through the opening 611 and the control surface 292, if optionally formed, is accessible to a user from the exterior of the lighting fixture 600. The light source 660 and the light source holder 670 are positioned within the cavity 619 once the lighting assembly 650 is coupled to the housing 610.

The optical lens 165 is rotatable 360 degrees and moves about a vertical axis extending through the opening 611 and aperture 674. As previously mentioned, the control surfaces 292 facilitate rotation of the optical lens 165 without having to physically make contact with the optical lens 165 by using an operator's fingers or a tool. According to some exemplary embodiments, since the optical lens 165 produces an asymmetric light output, rotation of the optical lens 265 allows an operator to further refine the direction of light output.

Although one example has been provided which allows the optical lens 165 to rotate about 360 degrees, the lighting assembly 650 is fabricated and/or coupled to the housing 610 in different manners in other exemplary embodiments, which allow the optical lens 165 to rotate 360 degrees or less about the same vertical axis. For example, in some alternative exemplary embodiments, the entire optical assembly 650 is disposed within the cavity 619 of the housing 610 and still allows the optical lens 165 to rotate 360 degrees. Although the optical lens 165 is described to rotate 360 degrees, it can be configured to rotate less than 360 degrees in other exemplary embodiments, such as through the use of position stops placed in the path of the control surfaces 292 or other known techniques.

Although the inventions are described with reference to exemplary embodiments, it should be appreciated by those skilled in the art that various modifications are well within the scope of the invention. From the foregoing, it will be appreciated that an embodiment of the present invention overcomes the limitations of the prior art. Those skilled in the art will appreciate that the present invention is not limited to any specifically discussed application and that the exemplary embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is not limited herein.

I claim:

1. An adjustable light assembly, comprising:

a housing comprising a sidewall having a first surface and a second surface facing away from the first surface, the first and second surface defining at least one light emitting opening and at least one first aperture that extends from the first surface through the second surface;

a light module comprising a substrate and at least one light source coupled thereto, wherein the substrate comprises at least one second aperture;

an optic lens disposed over at least a portion of the light source, wherein at least a portion of the optic lens extends away from the second surface, and wherein the optic lens is rotatably adjustable about an axis extending perpendicularly from the optic lens and including a portion of the light source; and a compression plate comprising:

at least one through opening that receives the portion of the optic lens therethrough such that the portion of the optic lens protrudes out from the compression plate through the at least one through opening, and at least one third through aperture located adjacent the at least one through opening, wherein the light module and the compression plate are disposed on opposite surfaces of the sidewall such that:

(a) the at least one first aperture, the at least one second aperture, and the at least one third through aperture are axially aligned, and (b) the at least one light emitting opening of the housing and the at least one through opening of the compression plate are axially aligned, and wherein a fastening device is received through the axially aligned at least one first aperture, the at least one second aperture, and the at least one third through aperture to fasten the light module and the compression plate to the housing.

2. The adjustable light assembly of claim 1, wherein the light module is positioned adjacent the first surface and oriented to emit light though the at least one light emitting opening.

3. The adjustable light assembly of claim 1, wherein the at least one light source comprises a light emitting diode ("LED") coupled thereto, the optic lens being disposed over the LED.

4. The adjustable light assembly of claim 1, wherein the optic lens further comprises:

a raised dome portion; and a flat portion extending about the perimeter of the raised dome portion.

5. The adjustable light assembly of claim 4, wherein the raised dome portion is asymmetrically shaped.

6. The adjustable light assembly of claim 4, wherein the raised dome portion is symmetrically shaped.

7. The adjustable light assembly of claim 1, wherein the optic lens further comprises one or more control surfaces for facilitating rotation of the optic lens about the axis.

8. The adjustable light assembly of claim 1, wherein the optic lens is rotatable about the axis up to 360 degrees or less.

9. A lighting fixture, comprising:

a housing comprising a base and a sidewall extending away from the perimeter of the base, at least a portion of the sidewall comprising at least one light emitting opening formed therein; and a light assembly coupled to the housing and comprising a light source holder that includes:

a first surface;

a second surface facing a direction opposite the first surface, the first and second surfaces defining an aperture extending therethrough; and one or more prongs extending substantially orthogonally away from the first surface, wherein the one or more prongs are configured to be coupled to fastening devices disposed in the housing so that the light source holder is substantially stationary when coupled to the housing;

a light source coupled to the light source holder; and an optic lens disposed over at least a portion of the light source, at least a portion of the optic lens extending away from the second surface, wherein the optic lens is rotatably adjustable about an axis extending perpendicularly from the optic lens and including a portion of the light source, and wherein the optic lens produces an asymmetric light output.

10. The lighting fixture of claim 9, wherein the optic lens further comprises:

a raised dome portion; and a flat portion extending about the perimeter of the raised dome portion.

11. The lighting fixture of claim 10, wherein the raised dome portion is asymmetrically shaped.

12. The lighting fixture of claim 9, wherein the optic lens is rotatable about the axis up to 360 degrees or less.

13. The lighting fixture of claim 9, wherein the optic lens further comprises one or more control surfaces for facilitating rotation of the optic lens about the axis.

14. A lighting fixture, comprising:

a light assembly coupled to the housing that includes at least one light emitting opening formed therein, wherein the light assembly comprises a light source holder that includes:

a first surface;

a second surface facing a direction opposite the first surface, the first and second surfaces defining an aperture extending therethrough;

one or more positional features formed along the first surface surrounding one or more portions of the aperture;

a light source coupled to the light source holder, wherein the light source is disposed on the first surface and positioned within a cavity of the housing, wherein the light source is oriented to emit light through the aperture and the light emitting opening, wherein the one or more positional features prevent the light source from rotating once the light source is coupled to the light source holder; and an optic lens disposed over at least a portion of the light source, at least a portion of the optic lens extending away from the second surface, wherein the optic lens is rotatably adjustable about an axis extending perpendicularly from the optic lens and including a portion of the light source, and wherein the optic lens produces an asymmetric light output.

15. The lighting fixture of claim 14, wherein the optic lens further comprises:

a raised dome portion; and a flat portion extending about the perimeter of the raised dome portion.

16. The lighting fixture of claim 15, wherein the raised dome portion is asymmetrically shaped.

17. The lighting fixture of claim 14, wherein the optic lens is rotatable about the axis up to 360 degrees or less.

18. The lighting fixture of claim 14, wherein the optic lens further comprises one or more control surfaces for facilitating rotation of the optic lens about the axis.

* * * * *